United States Patent [19]

Cowan

[11] 4,167,970

[45] Sep. 18, 1979

[54] HANGER APPARATUS FOR SUSPENDING PIPES

[75] Inventor: William S. Cowan, West University Place, Tex.

[73] Assignee: Armco Inc., Middletown, Ohio

[21] Appl. No.: 915,829

[22] Filed: Jun. 16, 1978

[51] Int. Cl.[2] ..... E21B 43/10

[52] U.S. Cl. ..... 166/208; 166/214; 285/141

[58] Field of Search ..... 166/115, 208, 214; 285/141

[56] References Cited

U.S. PATENT DOCUMENTS

| | | | |
|---|---|---|---|
| 3,216,503 | 11/1965 | Fisher, Jr. et al. | 166/208 |
| 3,227,218 | 1/1966 | Fisher, Jr. et al. | 166/208 |
| 3,378,077 | 4/1968 | Elliston | 166/115 |
| 3,420,308 | 1/1969 | Putch | 166/208 |
| 3,736,984 | 6/1973 | Garrett | 166/208 |
| 3,893,717 | 7/1975 | Nelson | 166/208 |
| 3,946,807 | 3/1976 | Amancharla et al. | 166/208 |

*Primary Examiner*—James A. Leppink

*Attorney, Agent, or Firm*—Roylance, Abrams, Berdo & Farley

[57] ABSTRACT

An improved hanger apparatus for suspending an inner pipe from an outer pipe or other annular member. The invention applies to hanger apparatus of the type comprising a hanger mandrel carried by an inner pipe, an outer hanger body, which can be carried by an outer pipe, and a resilient locking ring carried by the mandrel for connecting the mandrel to the hanger body to suspend the inner pipe. Hanger apparatus according to the invention have both special catch surfaces, coacting between the mandrel and outer hanger body to assure that full engagement occurs as a result of lowering the mandrel into the hanger body, and special load bearing surfaces for transferring the load to the outer hanger body when engagement has been achieved.

18 Claims, 8 Drawing Figures

HANGER APPARATUS FOR SUSPENDING PIPES

CROSS REFERENCES TO RELATED APPLICATIONS

The subject matter of this invention is related to my copending applications Ser. No. 915,830 and Ser. No. 915,902 filed concurrently herewith.

BACKGROUND OF THE INVENTION

It has long been a common practice in the well art to suspend an inner pipe, typically a casing string, concentrically within an outer member, typically an outer casing string or a wellhead member, by means of a hanger comprising a hanger member connected to the inner pipe and having a downwardly directed shoulder which engages an upwardly directed shoulder on the outer member as the inner pipe is run in. As the art developed, it became necessary to minimize the annular space between the inner and outer hanger members, and prior art workers have developed hangers employing a retractable hanger device carried by a mandrel on the inner pipe and capable of expanding into engagement with an outer hanger member when, as the inner pipe is run in, the mandrel reaches the outer hanger member. Pipe hangers of this type have become particularly important with the advent of offshore practices in which the hanger is located at the mudline and the outer pipe above the wellhead is of the same diameter as the outer casing below the wellhead and the annular space available for the hanger is relatively small. Such hangers are disclosed, for example, in the following U.S. patents:

U.S. Pat. No. 3,420,308; Putch
U.S. Pat. No. 3,472,530; Fowler
U.S. Pat. No. 3,741,589; Herd et al
U.S. Pat. No. 3,893,717; Nelson Though hangers of this general type have achieved considerable success, they still present problems which increase in severity as the annular space available at the hanger decreases and the weight of the pipe string to be supported increases. Thus, it has been difficult to assure that the retractable hanger device, which must retract radially as the mandrel passes into the outer hanger member, will expand into proper engagement with the outer hanger member. Further, with the outer hanger member provided with grooves to accommodate the retractable hanger device, engagement between the outer member and the retractable device has not been adequate to assure that the large tension loads applied by the inner pipe string are adequately supported. Both problem areas tend to require structures which are unduly large in radial directions, unduly complex and excessively expensive.

OBJECTS OF THE INVENTION

A general object of the invention is to devise an improved hanger of the type described, in which full engagement of the retractable hanger device with the outer hanger member is achieved without requiring added complexity or undue cost.

Another object is to provide such a hanger in which the load applied by the suspended pipe string is transferred to the outer hanger member more efficiently than in prior-art devices and without development of forces tending to disengage the coacting elements of the hanger.

A further object is to provide such a hanger in which the radial dimensions of the hanger members and the retractable hanger device are minimized.

Yet another object is to devise such a hanger which is simpler, and easier and less expensive to manufacture, than prior-art devices of this type.

A still further object is to provide such a hanger having a releasably restrained locking device with special catching means operative to release the locking device and positively lock the same in place only when the pipe to be suspended has been lowered to the precise position intended.

SUMMARY OF THE INVENTION

Broadly considered, hanger apparatus according to the invention are of the type comprising a hanger body carried by an outer pipe or other annular member, a hanger mandrel carried by an inner pipe to be suspended from the hanger body, and a resilient generally annular locking device, typically a split ring or an assembly of resiliently biased segments, carried by the mandrel and arranged to lock the mandrel to the hanger body when the inner pipe is lowered to cause the mandrel to pass downwardly into the hanger body. The locking device and hanger body have mating catching surfaces which extend inwardly and taper upwardly at a small angle, and which engage, when the mandrel is lowered through the hanger body, the catching surfaces serving to expand the locking device into its fully locked load-bearing position solely as a result of the downwardly acting load. The load bearing surfaces on the hanger mandrel, hanger body and locking ring are advantageously disposed at a 45° angle relative to the longitudinal axis of the pipes, arranged parallel to one another and aligned to transmit the loads in a straight line through the locking ring.

BRIEF DESCRIPTION OF THE DRAWINGS

In order that the manner in which the foregoing and other objects are achieved according to the invention can be understood in detail, particularly advantageous embodiments of the invention will be described with reference to the accompanying drawings, which form part of the original disclosure in this application, and wherein.

DETAILED DESCRIPTION OF THE EMBODIMENT OF FIGS. 1-2

Figure 1:
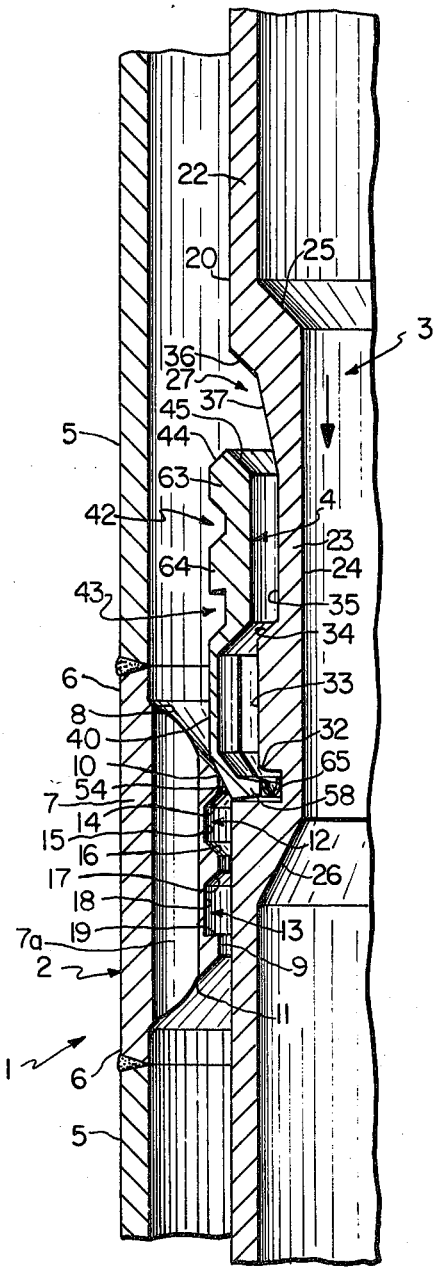
FIGS. 1–1C are fragmentary longitudinal cross-sectional views illustrating a hanger apparatus according to one embodiment of the invention, the figures being sequential, progressing from the illustration of the initial contact of the locking ring with the hanger body, in FIG. 1, to the illustration of the hanger completely landed and locked, in FIG. 1C.

Referring first to FIG. 1, the hanger apparatus 1 of this embodiment includes a hanger body 2, a hanger mandrel 3 and a locking ring 4. In this embodiment, hanger body 2 is carried by an outer pipe 5, such as a string of casing, and the hanger body is tubular, with an outer diameter equal to that of casing 5. End portions 6 of body 2 are right cylindrical and have the same wall thickness as the casing, each end portion being secured, as by welding, to the end of a different joint of the casing string. An intermediate portion 7 of body 2, which extends for most of the length of that body, is substantially thicker than end portions 6 and projects inwardly, being bounded at its upper end by a frusto-conical camming surface 8 which tapers downwardly and inwardly to join the right cylindrical inner surface 9 of portion 7 in an annular corner 10. The lower end of intermediate portion 7 is defined by an upwardly and inwardly tapering frusto-conical surface 11. Portion 7 is provided with a plurality of longitudinal through bores 7*a* which are spaced in a circular series and provide for fluid circulation through hanger body 2.

Inner surface 9 of portion 7 is interrupted by an upper transverse annular inwardly opening groove 12 and, spaced therebelow, a lower transverse annular inwardly opening groove 13. Upper groove 12 serves as a locking groove and is defined by a frusto-conical upper wall 14, which tapers upwardly and inwardly, a right cylindrical bottom wall 15, concentric with the longitudinal axis of pipe 5, and a frusto-conical load-bearing lower wall or shoulder 16 which tapers downwardly and inwardly. Lower groove 13 serves as a catching groove and has a frusto-conical upwardly and inwardly tapering upper wall 17, a right cylindrical bottom wall 18, concentric with the longitudinal axis of pipe 5, and a lower catching shoulder 19 which is frusto-conical and tapers upwardly and inwardly at a small angle, advantageously about 5°. Walls 14, 16 and 17 are advantageously each disposed at an angle of 45° relative to the pipe axis.

Hanger mandrel 3 is an integral body having a right cylindrical outer surface 20 equal in diameter to the outer surface of the inner pipe 21 to be suspended, typically a casing string. End portions 22 of the mandrel are of the same wall thickness as the inner pipe and are rigidly secured thereto, as by welding. An intermediate portion 23 of mandrel 3 has a right cylindrical inner surface 24 which extends for a substantial portion of the length of the mandrel and is of significantly smaller diameter than that of the inner surfaces of the end portions 22, surface 24 being joined to the inner surfaces of end portions 22 by frusto-conical shoulders 25 and 26. Portion 23 of the mandrel is provided with a stepped annular outwardly opening recess 27 which extends longitudinally for most of the length of intermediate portion 23 and is long as compared to portion 7 of the hanger body 2. The lower end of recess 27 is defined by a transverse annular stop shoulder 28 which faces upwardly and lies in a plane at right angles to the longitudinal axis of the mandrel. Shoulder 28 also forms the lower wall of a transverse annular outwardly opening retaining groove 29. Groove 29 has a cylindrical bottom wall 30, concentric with the longitudinal axis of the mandrel, and a transverse annular upper wall 31 parallel to shoulder 28, the outer periphery of wall 31 being chamfered to provide a short downwardly and inwardly tapering frusto-conical camming surface 32.

Figure 1A:
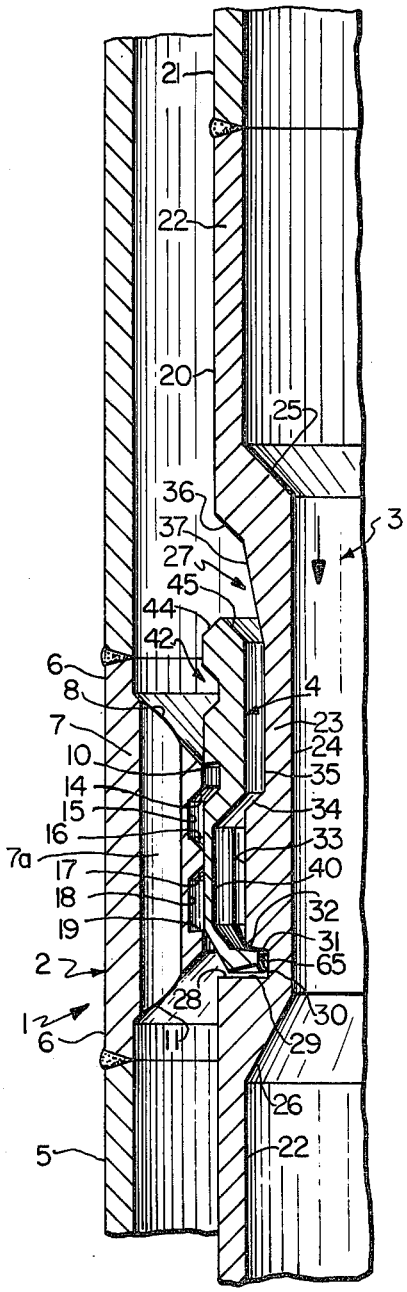
Figure 1B:
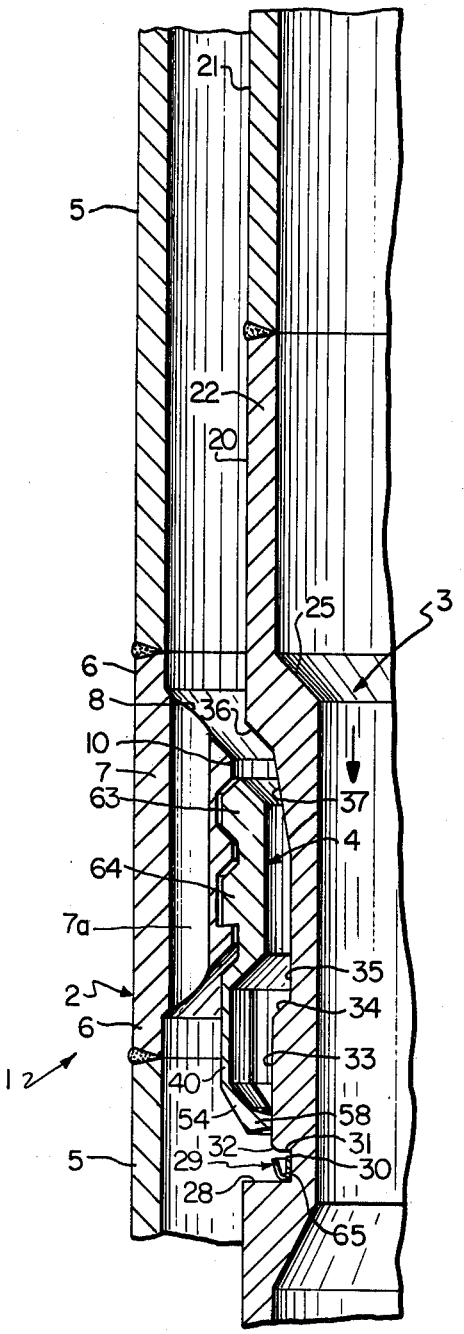
Figure 1C:
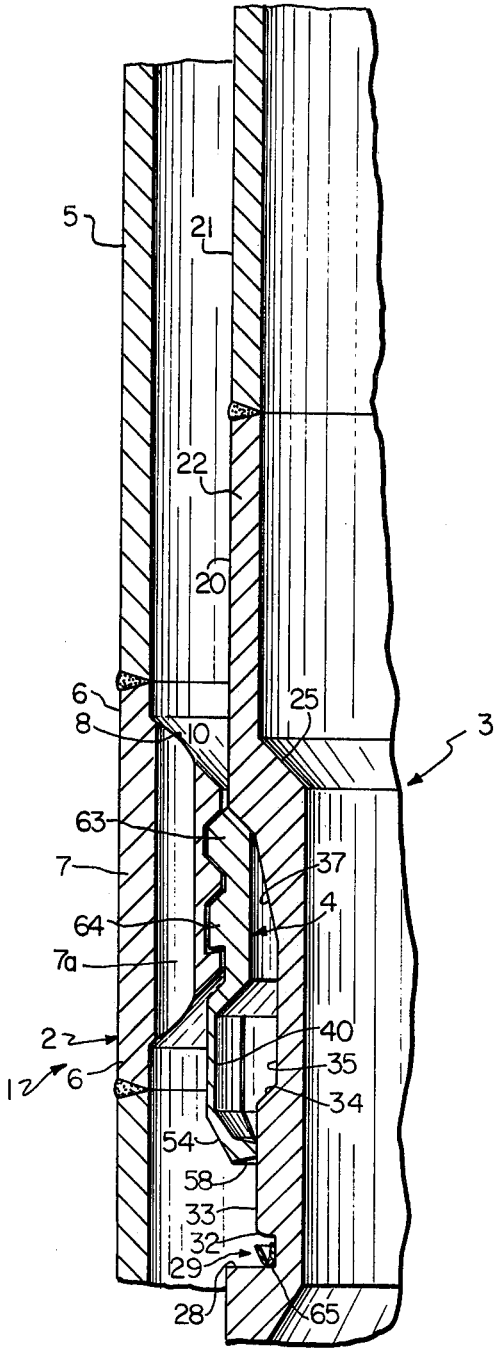

Recess 27 is further defined by a larger diameter right cylindrical surface 33, which commences at camming surface 32, an upwardly and inwardly tapering frusto-conical surface 34 at the upper end of surface 33, a smaller diameter right cylindrical surface 35, which commences at the upper end of surface 34, a frusto-conical downwardly and inwardly tapering load-bearing shoulder 36 constituting the upper end of recess 27, and a frusto-conical intermediate surface 37 tapering at a small angle downwardly and inwardly to connect the inner periphery of shoulder 36 and the upper end of surface 35. Shoulder 36 is at an angle of 45° to the pipe axis so as to be parallel to load-bearing shoulder 16 of groove 12 when the mandrel and hanger body are concentric, as when the mandrel and hanger body have been landed as seen in FIG. 1C.

Figure 2:
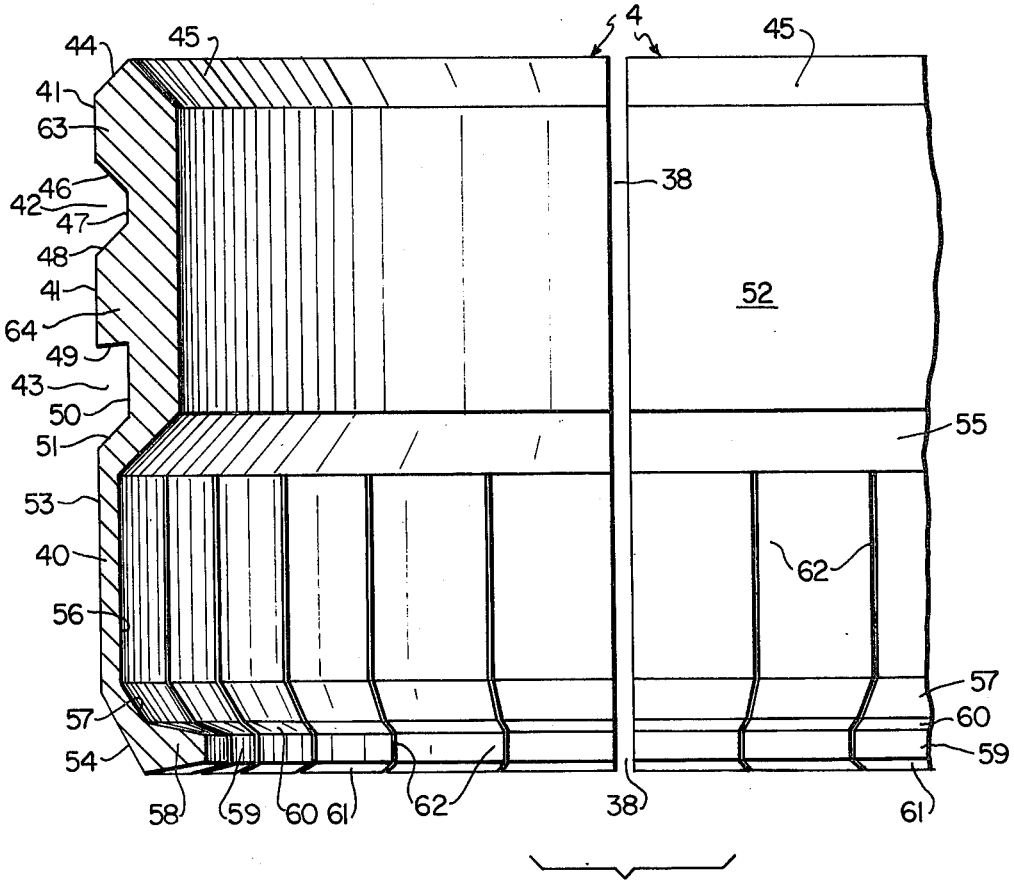
FIG. 2 is a view, partly in longitudinal cross-section and partly in side elevation, of the locking ring of the apparatus of FIG. 1.

Shown in detail in FIG. 2, locking ring 4 is an integral resilient metal ring split longitudinally throughout its full length at 38. Ring 4 comprises an upper annular main body portion 39 and a skirt 40, main body portion 39 being thick in comparison with the skirt, and the skirt depending from the main body portion. Main body portion 39 has a right cylindrical outer surface 41 interrupted by transverse annular outwardly opening grooves 42 and 43. The upper end of body portion 39 is defined by converging frusto-conical shoulders 44 and 45, shoulder 44 tapering from outer surface 4 upwardly and inwardly at 45° to the longitudinal axis of the ring, and shoulder 45 tapering downwardly and inwardly at 45° to the axis of the ring.

Groove 42 is defined by an upper frusto-conical wall or shoulder 46 which tapers downwardly and inwardly so as to be parallel with shoulder 45, a right cylindrical bottom wall 47, and a lower frusto-conical wall 48 which tapers upwardly and inwardly. Groove 43 is defined by a frusto-conical upper wall 49 or shoulder which tapers upwardly and inwardly at the same small angle as does catching shoulder 19 of body 2, a right cylindrical bottom wall 50, and a frusto-conical lower wall 51 which tapers upwardly and inwardly at 45° . Body portion 39 has a main right cylindrical inner surface 52.

Skirt 40 is markedly thinner, and therefore markedly more resilient, than is body portion 39. The outer surface of the skirt is defined by the lower wall 51 of groove 43, a right cylindrical outer surface portion 53, and a downwardly and inwardly tapering frusto-conical camming surface 54. The inner surface of skirt 40 is defined by an upwardly and inwardly tapering frusto-conical surface portion 55, a right cylindrical inner surface portion 56, and a downwardly and inwardly tapering frusto-conical surface portion 57. Formed integrally with skirt 40 at the bottom end thereof is a transverse annular inwardly directed retaining flange as defined by a right cylindrical inner wall 59, which is concentric with the longitudinal axis of the ring, and converging upper and lower frusto-conical side surfaces 60 and 61. To increase its resiliency, skirt 40 is provided with a plurality of longitudinal slits 62 each extending from surface portion 55 throughout the length of the skirt and opening through flange 58.

At the upper end of ring 4, shoulder 44, upper wall 46 of groove 42, and the portion of surface 41 between shoulder 44 and groove 42 combine to define a transverse annular locking rib 63. Similarly, lower wall 48 of groove 42, upper wall 49 of groove 43 and the portion of surface 41 between walls 48 and 49 combine to define a transverse annular catching rib 64. Ribs 63 and 64 are spaced apart by a distance such that the portion of body 2 defined by surfaces 16,17 and the portion of surface 9 therebetween can be fully accommodated in groove 42. The axial width of rib 64 is very slightly smaller than the axial width of groove 13. Thus, rib 63 can mate fully with groove 12, and with rib 63 so mated, rib 64 is fully accommodated by groove 13 and shoulder 49 is spaced very slightly above shoulder 19, as seen in FIG. 1C.

The inwardly projecting bottom flange 58 on the skirt of locking ring 4 is dimensioned to be accommodated by groove 29 of mandrel 3. Ring 4 is installed on mandrel 3 before the mandrel is rigidly secured, as by welding, to two joints of the inner pipe, installation being accomplished by expanding the split ring and slipping the ring over one end of the mandrel, then moving the ring axially until flange 58 is aligned with groove 29, at which point the ring is allowed to relax so that the inner periphery of flange 58 is disposed just within the mouth of groove 29, as seen in FIG. 1. Advantageously, an annular radially resilient sheet metal spring 65 of generally U-shaped radial cross section is disposed within groove 29, with the U of the spring opening upwardly, to maintain ring 4 approximately centered on the mandrel. When the ring is in its initial position, the juncture between surfaces 54 and 61 engages shoulder 28, and the inner surface 59 of flange 58 is in a position such that, if the mandrel is moved downwardly relative to ring 4, the corner presented by surfaces 60 and 59 will engage camming surface 32. The length of cylindrical surface 33 of the mandrel is such that the portion of the mandrel defined by the upper wall of groove 29, surface 33 and surface 34 can be accommodated between flange 58 and surface 55 of the skirt of the ring. Similarly, main body portion 39 of ring 4 is shorter than the space between surface 34 and shoulder 36, so that the main body of the ring can be freely accommodated in that portion of recess 27 between those two surfaces.

Installation of outer pipe 5 positions hanger body 2 at that location from which the inner pipe 21 is to be suspended. As the inner pipe is run in, ring 4 remains in the position on mandrel 3 seen in FIG. 1, being retained by engagement of flange 58 in groove 29. As the intermediate portion 23 of the mandrel enters hanger body 2, surface 54 of the skirt of the locking ring engages the corner 10 presented at the inner periphery of camming surface 8 of body 2. Further downward movement of the inner pipe causes locking ring 4 to be compressed inwardly. Initially, such compression is concentrated in skirt 40, occurring both because of the relatively thin wall of the skirt and because of the provision of slits 62. As downward movement of the inner pipe continues, such compression progresses until all of surface 54 has passed corner 10, and the outer cylindrical surface 53 of skirt 40 is now embraced by the inner cylindrical surface 9 of intermediate portion 7 of hanger body 2, as seen in FIG. 1A. At this stage, the corner defined by shoulder 49 and surface 41 can engage surface 8, and main body portion 39 of the ring is also compressed, such compression being allowed by slit 38. Throughout such further downward movement, flange 58 remains engaged in groove 29 to releasably hold ring 4 in its initial axial position relative to mandrel 3.

Continued downward movement of the combination of mandrel 3 and ring 4 causes catching rib 64 to pass downwardly to the location of catching groove 13. It will be noted that, as rib 64 passes groove 12, skirt 40 is still embraced by inner surface 9 of portion 7 of body 2, so the ring 4 cannot expand to cause engagement of rib 64 in groove 12. As rib 64 begins to mate with groove 13, the locking rib 63 simultaneously begins to mate with locking groove 12 and, since the locking ring is now resiliently contracted, the ring begins to spring outwardly. Thus, catching rib 64 has begun to enter groove 13 as the ring further descends, and catching shoulder 49 of the ring is now partly overlapped with catching shoulder 19 of the hanger body. As downward movement continues, shoulder 49 engages shoulder 19 and the, e.g., 5° taper of these two shoulders causes the two shoulders to coact to help force ring 4 outwardly until, as seen in FIG. 1B, locking rib 63 has mated with locking groove 12.

When shoulder 49 engages shoulder 19, further downward movement of ring 4 is prevented. Mating of the main body portion 39 of ring 4 with hanger body 2 not only allows but positively assures relaxation of ring 4 to substantially its fully relaxed diameter. Accordingly, with downward movement of the ring now prevented by engagement of shoulders 49 and 19, the corner of flange 58, defined by surfaces 59 and 60, is disposed to be engaged by the camming surface 32. Further downward movement of mandrel 3, as lowering of the inner pipe continues, causes flange 58 to ride over camming surface 32 so that the flange embraces surface 33 of the mandrel, as seen in FIG. 1B. Since surface 33 has a diameter slightly larger than the relaxed diameter of inner surface 59 of flange 58, skirt 40 is now resiliently distorted outwardly, tending further to assure proper mating of the locking ring with the hanger body. Continued downward movement of the mandrel causes the load-bearing shoulder 36, at the upper end of recess 27, to engage load-bearing shoulder 45 of the locking ring, forcing shoulder 46 of the locking ring into load-bearing engagement with lower wall 16 of groove 12. Since shoulders 36, 45, 46 and 16 are all at 45° to the pipe axis, the total downwardly acting load presented by the inner string of pipe is applied in a straight line at right angles to the four parallel surfaces.

The elongated intermediate frusto-conical surface 37 of mandrel 3 serves only to assure final centering of locking ring 4 relative to the mandrel as the load-bearing surfaces come into full engagement. Engagement of the load-bearing surfaces under the heavy downward load applied by the inner pipe string serves to force body portion 39 of the locking ring radially outwardly so that locking rib 63 is forced further into locking groove 12.

Ring 4, with its camming surface 54, its resilient skirt and catching shoulder 49, has the capability of distinguishing groove 13 and the catching shoulder 19 of that groove from other obstructions within outer pipe 5 which are encountered during the trip of the combination of the mandrel and locking ring down pipe 5. The manner in which ring 4 enters the intermediate portion 7 of body 2 and then, in effect ignores presence of groove 12 as rib 64 passes that groove, is typical of the manner in which the locking ring responds to obstructions and ignores the obstructions so far as its catching action is concerned. On the other hand, once catching rib 64 has reached catching groove 13, engagement of shoulder 49 with shoulder 19 positively causes flange 58 to be released from groove 29 and positively causes the locking ring to expand radially to assure full engagement with hanger body 2.

When it is desired to remove the inner pipe string 21, application of an upward strain to that pipe string causes the inner pipe string to move upwardly through the locking ring 4. Inner surface 59 of flange 58 rides on cylindrical surface 33 of the mandrel until groove 29 reaches the position of flange 58 and the flange snaps back into groove 29. At this point, the juncture between surfaces 54 and 61 of ring 4 is again engaged with shoulder 28. Continuation of the upward strain on the inner pipe string now urges ring 4 upwardly, causing shoulder 44 to engage shoulder 14 of body 2 and simultaneously causing shoulders 48 and 51 of ring 4 to engage shoulders 17 and 11, respectively, of body 2. Those engaged shoulders now serve to cam ring 4 radially inwardly, such radial compression of the ring being permitted by slit 38. Thus, ribs 63 and 64 of the locking ring are disengaged from grooves 12 and 13 and the locking ring passes upwardly through body 2, the inner pipe string now being free for its return trip to the surface.

While catching shoulders 19 and 49 advantageously taper at an angle of about 5° C. relative to planes at right angles to the longitudinal pipe axis, the angle of taper of those shoulders can be in the range of 2° to 10°, smaller angles having a reduced tendency to urge the locking ring outwardly, and larger angles having an increased danger of damage to the corners at the peripheries of the shoulders. While shoulders 36, 45, 46 and 16 are advantageously at 45°, the angle of taper of these shoulders can be 30°–60°, so long as all four shoulders are essentially parallel to each other.

THE EMBODIMENT OF FIGS. 3–4

Figure 3:
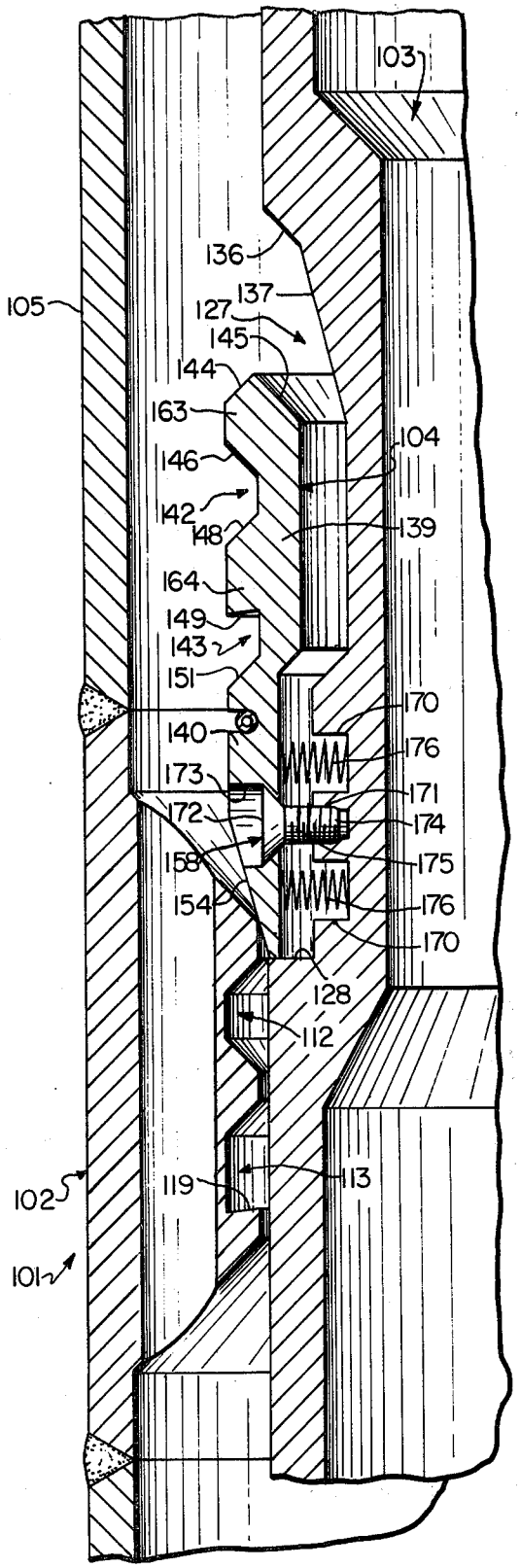
FIGS. 3 and 3A are fragmentary longitudinal cross-sectional views illustrating a hanger apparatus according to another embodiment of the invention, FIG. 3 illustrating the initial contact of the locking ring with the hanger body and FIG. 3A illustrating the hanger completely landed.
Figure 4:
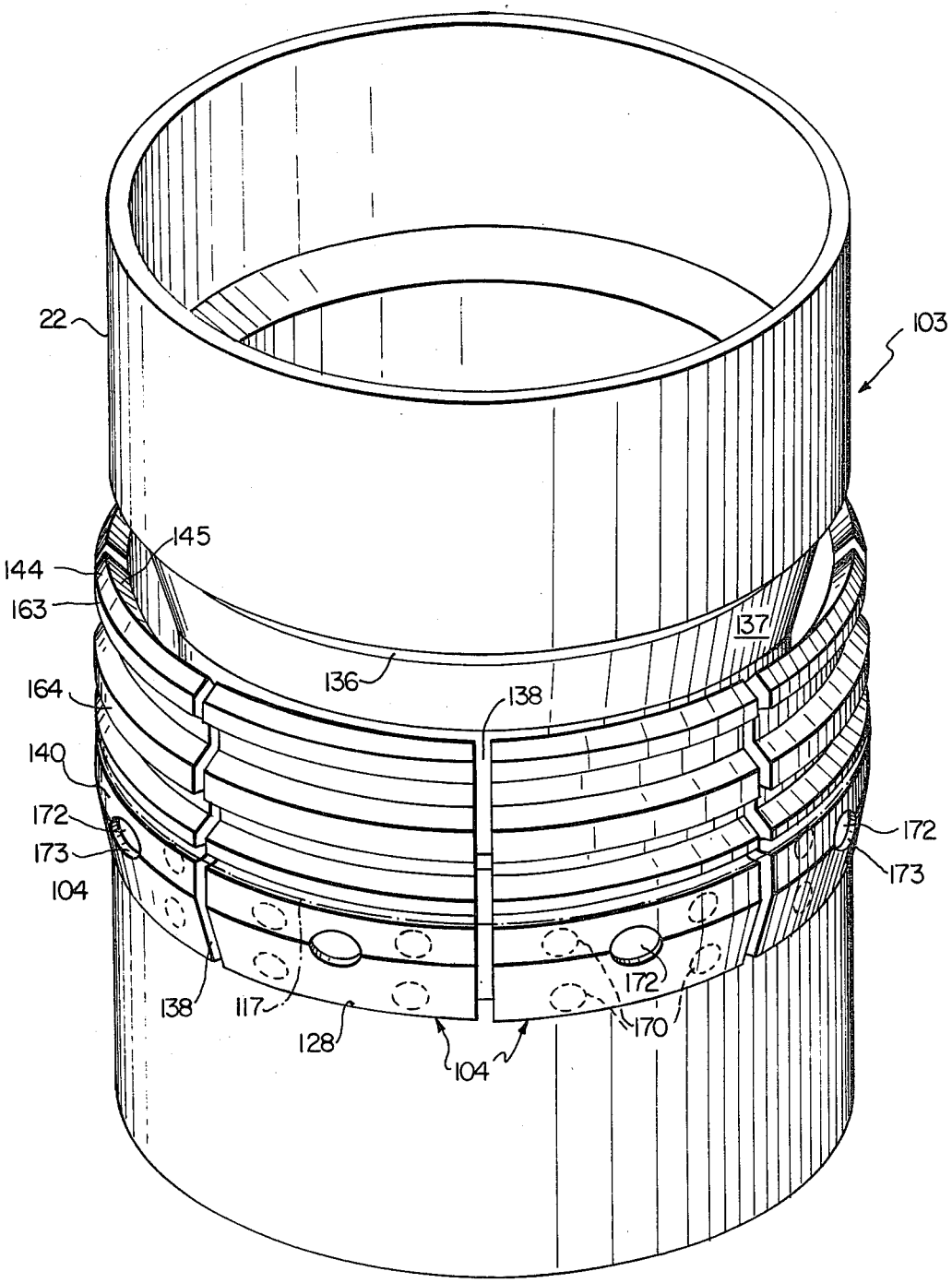
FIG. 4 is a perspective view illustrating the locking ring and hanger mandrel of the apparatus of FIGS. 3 and 3A.

Though the embodiment of FIGS. 1–2 is particularly advantageous, the advantages of the invention can be achieved with other structures. FIGS. 3–4 illustrate an embodiment of the invention in which the split ring 4 of the embodiment of FIGS. 1–2 is replaced by an annular series of spring-biased locking segments, and the retaining means comprising flange 58 and groove 29 of the embodiment of FIGS. 1–2 is replaced by shear members.

In the embodiment of FIGS. 3–4, the hanger apparatus 101 comprises a tubular hanger body 102 secured, as by welding, to outer pipe 105. The apparatus again includes a tubular hanger mandrel 103 secured to an inner pipe string 121. The annular lock means of the apparatus comprises a plurality of arcuate locking segments 104.

The outer hanger body 102 is in all respects identical to hanger body 2, FIGS. 1–2. Mandrel 103 again has a transverse annular outwardly opening stepped recess 127, but the groove 29, FIGS. 1–2, is eliminated and larger diameter right cylindrical outer surface portion 133 extends for the full distance from stop shoulder 128 to the frusto-conical surface 134. Two axially spaced circular series of outwardly opening recesses 170 are provided in the portion of mandrel 103 which presents outer surface 133. A circular series of outwardly opening threaded blind bores 171 is provided in the location between the two series of recesses 170. Save for these differences, mandrel 103 is identical to mandrel 3 of FIGS. 1–2, and therefore presents, at the upper end of recess 127, a downwardly and inwardly tapering frusto-conical load-bearing shoulder 136 and a downwardly and inwardly tapering frusto-conical intermediate surface portion 137.

As seen in FIG. 4, eight of the arcuate locking segmnts 104 are employed to provide an annular series of locking segments which extends completely around mandrel 103, there being a slot-like space 138 between each adjacent pair of the locking segments.

Segments 104 are all mutually identical. Each segment 104 comprises a main body portion 139 and a dependent skirt portion 140. Main body portion 139 has outwardly opening grooves 142 and 143, an outer right cylindrical surface portion 141, upper end shoulders 144 and 145, and shoulders 146, 148, 149 and 151, all of these elements being identical to the corresponding elements described with reference to FIGS. 1–2. Skirt 140 includes, at its lower end, a downwardly and inwardly tapering frusto-conical camming surface 154.

Surfaces 144, 146, 148 and 149, together with the outer cylindrical surface of the segment, combine to define locking rib 163 and catching rib 164. Hanger body 102 presents a locking groove 112 and a catching groove 113 identical with the corresponding grooves in FIGS. 1–2.

Each segment 104 is initially retained by a shear screw 158 having a head 172 engaged in an outwardly opening socket 173 centered on skirt 140. Each screw 158 includes a threaded portion 174, engaged in one of the threaded bores 171. The segment is biased outwardly, to bring the bottom of socket 173 into engagement with the head 172 of the shear screw 158 by four coil compression springs 176 each disposed in a different one of four of the recesses 170, the inner ends of the springs being seated in the mandrel. Thus, springs 176 and shear screws 158 coact to retain segments 104 in the same position, spaced outwardly of the mandrel, which would be occupied by a corresponding portion of the resilient ring 104 of the embodiment of FIGS. 1–2. Further, the shear screws and springs allow the segments to be urged inwardly, compressing springs 176, and to be returned outwardly by the springs, as the inner pipe 121 is lowered.

Figure 3A:
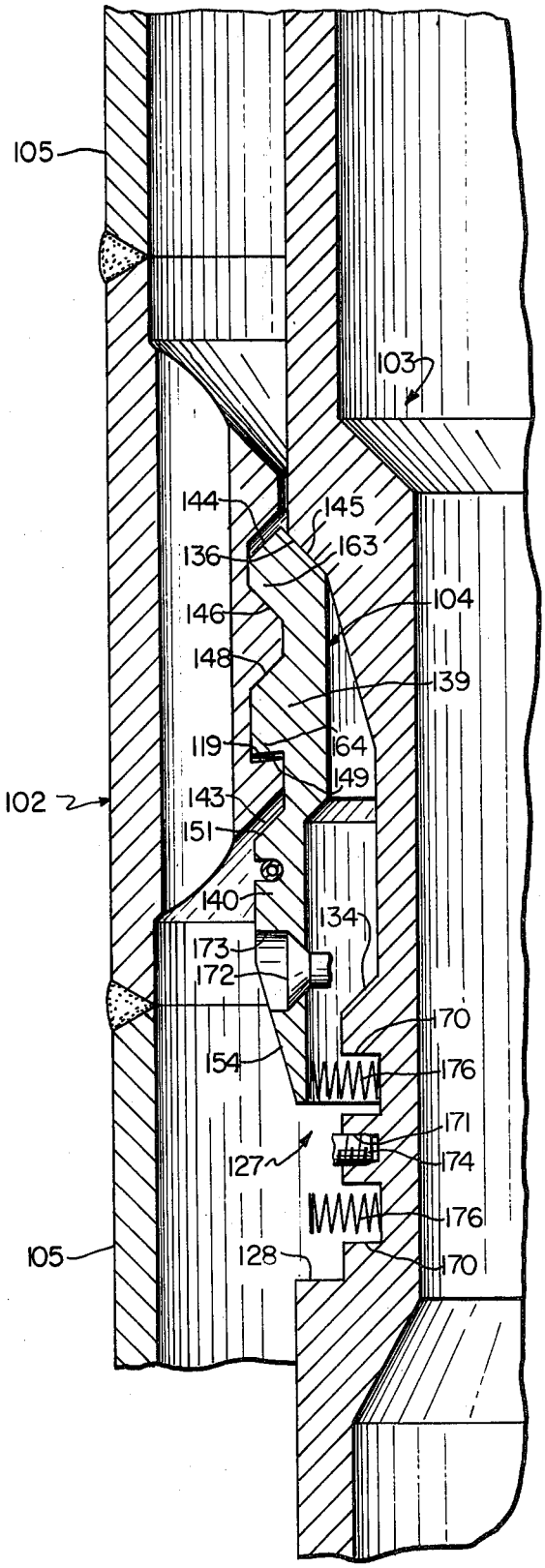

As mandrel 103 passes through hanger body 102, surface 154 comes into engagement with the upper end of the inwardly enlarged intermediate portion of the hanger body, as seen in FIG. 3. Further downward movement causes surface 154 to cam the segment inwardly, so that the segment can continue its downward travel into the hanger body, along with the mandrel. When catching rib 164 begins to match catching groove 113, the segments 104 can move outwardly, and are urged outwardly by springs 176, so that shoulders 149 overlap catching shoulder 119 of body 102. When shoulder 149 of each segment engages shoulder 119, the segments are prevented from moving downwardly, and further downward movement of the mandrel, as the inner pipe is lowered, therefore causes shear screws 158 to shear, freeing the mandrel from the segments. Continued downward movement of the mandrel therefore brings the combination of mandrel 103 and segments 104 to the positions seen in FIG. 3A, the mandrel therefore now being fully locked to hanger body 102 in the same manner hereinbefore described with reference to the embodiment of FIGS. 1–2. The downward load applied by the inner pipe string is applied to body 102 through segments 104 in the same fashion earlier described. Also, the inner pipe string can be recovered, with segments 104 being cammed inwardly as described with reference to the embodiment of FIGS. 1–2, it being recognized that the lower ends of the segments come into engagement with stop shoulder 128 of the mandrel as the mandrel begins to move upwardly.

Since the inner ends of springs 175 are fixed to the mandrel, the springs do not escape into the well after the shear screws are broken. The segments 104 are advantageously retained on the mandrel, as by a garter spring 176 engaged about all of the segments 104 and extending through transverse outwardly opening grooves in skirt 140.

Though the illustrative embodiments shown and described employ a single locking groove, as at 12, FIG. 1, and a single locking rib, as at 63, FIG. 1, it will be apparent that two or more locking grooves and a corresponding number of locking ribs can be employed.

What is claimed is:

1. In a hanger apparatus for suspending an upright inner pipe from an outer pipe or other annular outer member, the combination of a hanger body carried by the outer member, said hanger body having a plurality of transverse annular inwardly opening grooves spaced apart axially of the hanger body, an upper one of said grooves constituting a locking groove and having a generally frusto-conical lower wall which tapers downwardly and inwardly, a lower one of said grooves constituting a catching groove and having a generally frusto-conical lower wall which tapers upwardly and inwardly at a small angle;

a hanger mandrel carried by the inner pipe, said hanger mandrel having a transverse annular recess opening outwardly into the annular space between the inner pipe and the outer member, there being a transverse annular downwardly facing end surface at the upper end of said recess; and generally annular lock means carried by said hanger mandrel, said lock means being disposed in said recess and having an outer peripheral configuration presenting a transverse annular downwardly directed catching shoulder tapering upwardly and inwardly at a small angle and being capable of mating with said lower wall of said catching groove, and a transverse annular downwardly directed support shoulder tapering downwardly and inwardly and being capable of mating with said lower wall of said locking groove, said lock means having a transverse annular upwardly directed support shoulder capable of mating with said end surface of said recess, said lock means being axially shorter than said recess and being radially yieldable, the normal relaxed diameter of the lock means being such that, as the hanger mandrel is lowered through the hanger body, the lock means is radially distorted inwardly by engagement with the hanger body to allow the lock means to move downwardly until said catching shoulder engages said lower wall of said catching groove, whereby further downward movement of the mandrel causes said end surface of said recess to come into load-bearing engagement with said upwardly directed support shoulder of the lock means.

2. The combination defined in claim 1, wherein said upwardly directed support shoulder of said lock means is frusto-conical and tapers downwardly toward said mandrel, and said end surface of said recess is frusto-conical and tapers downwardly and inwardly.

3. The combination defined in claim 2 wherein said end surface of said recess, said upwardly directed support shoulder of said lock means, said downwardly directed support shoulder of said lock means, and said lower wall of said lock groove are all mutually parallel to each other.

4. The combination defined in claim 3, wherein said end surface, said shoulders and said wall taper at an angle of from 30° to 60°.

5. The combination defined in claim 4, wherein said angle is approximately 45°.

6. The combination defined in claim 1, wherein said lock means and said mandrel have coacting retaining means releasably retaining the lock means in an initial position in which said upwardly directed support shoulder of the lock means is spaced below said downwardly facing end surface of the recess;

said recess includes a portion located intermediate the ends of the recess and defined by a first cylindrical outer surface portion of the mandrel which is of substantially smaller diameter than the smaller diameter portion of said downwardly facing end surface of the recess; and said lock means includes a generally annular body portion which carries said catch shoulder, said downwardly directed support shoulder and said upwardly directed support shoulder, said body portion having a cylindrical inner surface of substantially larger diameter than said first cylindrical outer surface portion of the mandrel, said body portion of the lock means surrounding said first cylindrical outer surface portion of the mandrel when the lock means is in said initial position, said body portion of the lock means engaging only said downwardly facing end surface of the recess and being otherwise spaced outwardly from the mandrel when said further downward movement of the mandrel has caused said upwardly directed support shoulder of the lock means to engage said downwardly facing end surface of the recess.

7. The combination defined in claim 6, wherein said first cylindrical outer surface portion of the mandrel is spaced from said downwardly facing end surface of the recess; and the outer surface of the mandrel tapers downwardly from said downwardly facing end surface of the recess to said first cylindrical outer surface portion.

8. The combination defined in claim 7, wherein said downwardly facing end surface of the recess and said upwardly directed support shoulder of the lock means are mutually parallel frusto-conical surfaces which taper downwardly and inwardly.

9. The combination defined in claim 1, wherein said lock means is an integral member in the form of a split ring.

10. Apparatus according to claim 1, wherein the outer surface of the lower end portion of said lock means tapers downwardly and inwardly to provide an annular camming surface to engage the upper end of the hanger body as the inner pipe is lowered through the outer member.

11. Apparatus according to claim 1, wherein said locking groove has a generally frusto-conical upper wall which tapers upwardly and inwardly; and the upper end of said lock means comprises, outwardly of said upwardly directed support shoulder, a first upwardly directed generally frusto-conical camming surface which tapers upwardly and inwardly, application of an upward strain on the inner pipe, after the lock means has been operatively engaged with the hanger body, causing said first upwardly directed camming surface to engage said upper wall of the lock groove, said upwardly directed camming surface and said upper wall then coacting to radially compress the lock means so that the combination of the mandrel and lock means can be withdrawn from the hanger body.

12. Apparatus according to claim 11, wherein said catching groove has an upper frusto-conical wall which tapers upwardly and inwardly; and said lock means comprises a second upwardly directed generally frusto-conical camming surface which tapers upwardly and inwardly and is disposed above said downwardly directed catching shoulder to cooperate with the upper wall of said catching groove, the distance between said lower and upper walls of said catching groove being slightly greater than the distance between said second upwardly directed camming surface and said downwardly directed catching shoulder, said downwardly directed catching shoulder being out of load-bearing engagement with said lower wall of said catching groove when, under the load applied to the lock means by the inner pipe, said downwardly directed support shoulder of the lock means is fully mated with said lower wall of said locking groove.

13. In a hanger apparatus for suspending an inner pipe from an outer pipe or other annular outer member, the combination of a tubular hanger body to be carried by the outer member, said hanger body having an upwardly directed transverse annular camming surface and, below said camming surface, a plurality of transverse annular inwardly opening grooves spaced apart axially of the hanger body, an upper one of said grooves constituting a locking groove defined by a generally frusto-conical lower wall which tapers downwardly and inwardly to form an upwardly directed load-bearing shoulder, an annular bottom wall, and a generally frusto-conical upper wall which tapers upwardly and inwardly to form a first downwardly directed camming shoulder, a lower one of said grooves constituting a catching groove defined by a generally frusto-conical lower wall which tapers upwardly and inwardly at a small angle to form an upwardly directed catching shoulder, an annular bottom wall, and a generally frusto-conical upper wall which tapers upwardly and inwardly to form a second downwardly directed camming shoulder;

a hanger mandrel to be carried by the inner pipe, said hanger mandrel having an axially elongated transverse annular outwardly opening recess, the upper end of said recess being defined by a transverse annular downwardly facing load-bearing shoulder, the lower end of said recess being defined by a transverse annular upwardly facing stop shoulder;

generally annular radially resilient lock means carried by said mandrel, said lock means being axially shorter than said recess and disposed therein, said lock means having a transverse annular outwardly projecting upper locking rib and, spaced therebelow, a transverse annular outwardly projecting catching rib, said locking rib being defined by a generally frusto-conical upper surface which tapers upwardly and inwardly at substantially the same angle as does said first downwardly directed camming shoulder of said locking groove, an annular outer surface, and a generally frusto-conical lower surface which tapers downwardly and inwardly at substantially the same angle as does said load-bearing shoulder of said locking groove, said catching rib being defined by a generally frusto-conical upper surface which tapers upwardly and inwardly at substantially the same angle as does the upper wall of said catching groove, an annular outer surface, and a generally frusto-conical lower surface which tapers upwardly and inwardly at substantially the same small angle as does the lower wall of said catching groove, the lower end portion of said lock means presenting a downwardly facing transverse annular downwardly and inwardly tapering camming surface, the diameter of said lock means when in its relaxed undistorted condition being such that the inner diameter of said upwardly directed camming surface of said hanger body is smaller than the outer diameter and larger than the inner diameter of said downwardly facing camming surface presented by the lower end portion of said lock means, the upper end portion of said lock means presenting a transverse annular upwardly directed load-bearing shoulder for engagement with said shoulder at the upper end of said recess, the effective axial width of said catching rib being slightly smaller than the effective axial width of said catching groove; and releasable retaining means releasably securing said lock means to said mandrel in a position in which the load-bearing surface presented by the upper end portion of said lock means is spaced below said upper end of said recess.

14. The combination defined in claim 13, wherein said downwardly directed load-bearing shoulder defining the upper end of said recess is frusto-conical and tapers downwardly and inwardly at an angle of 30°–60°;

said upwardly directed load-bearing shoulder at the upper end of said lock means is frusto-conical and tapers downwardly and inwardly at substantially the same angle as does said shoulder which defines the upper end of said recess; and said lower wall of said locking groove and said lower surface of said locking rib taper at substantially the same angle as do said load-bearing shoulder at the upper end of said recess and said load-bearing shoulder at the upper end of said lock means.

15. The combination defined in claim 14, wherein said angle is about 45°.

16. The combination defined in claim 14, wherein said upwardly directed catching shoulder of said catching groove and said lower surface of said catching rib taper at an angle of 2°-10°.

17. The combination defined in claim 16, wherein the angle of taper of said catching shoulder and of said lower surface of said catching rib is about 5°.

18. The combination defined in claim 13, wherein said lock means is a resilient split ring; and said releasable retaining means comprises a transverse annular outwardly opening retaining groove in said mandrel adjacent and above said upwardly facing stop shoulder, and an inwardly projecting flange carried by said split ring at the lower end thereof and projecting into said retaining groove when said ring is in its relaxed undistorted condition.

* * * * *